US011724506B2

(12) United States Patent
Abe

(10) Patent No.: US 11,724,506 B2
(45) Date of Patent: Aug. 15, 2023

(54) PRINTING APPARATUS AND PRINTING METHOD

(71) Applicant: CANON KABUSHIKI KAISHA, Tokyo (JP)

(72) Inventor: Shodai Abe, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/552,626

(22) Filed: Dec. 16, 2021

(65) Prior Publication Data

US 2022/0194086 A1 Jun. 23, 2022

(30) Foreign Application Priority Data

Dec. 18, 2020 (JP) ..... JP2020-210592

(51) Int. Cl.
*B41J 2/175* (2006.01)
*B41J 13/02* (2006.01)

(52) U.S. Cl.
CPC ..... *B41J 2/175* (2013.01); *B41J 13/02* (2013.01)

(58) Field of Classification Search
CPC .... B41J 2/175; B41J 2/17509; B41J 13/0018; B41J 13/02
See application file for complete search history.

(56) References Cited

U.S. PATENT DOCUMENTS

2012/0300010 A1* 11/2012 Kawanabe ..... G03G 15/0131 347/232
2014/0125752 A1* 5/2014 Miyadera ..... G03G 15/043 347/118

FOREIGN PATENT DOCUMENTS

JP 2016-043624 A 4/2016

* cited by examiner

*Primary Examiner* — Anh T Vo
(74) *Attorney, Agent, or Firm* — Venable LLP

(57) ABSTRACT

A printing apparatus includes a conveyance unit configured to convey a print medium, a storage unit configured to store ink, a printhead configured to discharge ink supplied from the storage unit to print onto the print medium, and a signal acquiring unit configured to acquire a signal related to a remaining amount of ink in the storage unit. The signal acquiring unit, in accordance with a start of conveyance by the conveyance unit, starts acquisition of the signal.

12 Claims, 6 Drawing Sheets

PRINTING APPARATUS AND PRINTING METHOD

BACKGROUND OF THE INVENTION

Field of the Invention

The present invention relates mainly to printing apparatuses.

Description of the Related Art

Among printing apparatuses as typified by ink jet printers and the like, there is a printing apparatus in which an electrode is provided in a storage unit for storing ink, and an electric signal is applied to the electrode to detect a remaining amount of ink in the storage unit (see Japanese Patent Laid-Open No. 2016-43624). When the remaining amount of ink in the storage unit does not satisfy a criterion, it is necessary to replenish the storage unit with ink or replace the storage unit with a new one.

Several tens of msec (milliseconds), for example, are required to detect the remaining amount of ink in the ink storage unit. Therefore, there may be demand for improvement in the control in order to speed up the printing of a plurality of sheets.

SUMMARY OF THE INVENTION

An exemplary object of the present invention is to provide a technique that is advantageous for speeding up printing of a plurality of sheets.

One of the aspects of the present invention provides a printing apparatus, comprising a conveyance unit configured to convey a print medium, a storage unit configured to store ink, a printhead configured to discharge ink supplied from the storage unit to print onto the print medium, and a signal acquiring unit configured to acquire a signal related to a remaining amount of ink in the storage unit, wherein the signal acquiring unit, in accordance with a start of conveyance by the conveyance unit, starts acquisition of the signal.

Further features of the present invention will become apparent from the following description of exemplary embodiments with reference to the attached drawings.

DESCRIPTION OF THE EMBODIMENTS

Figure 1:
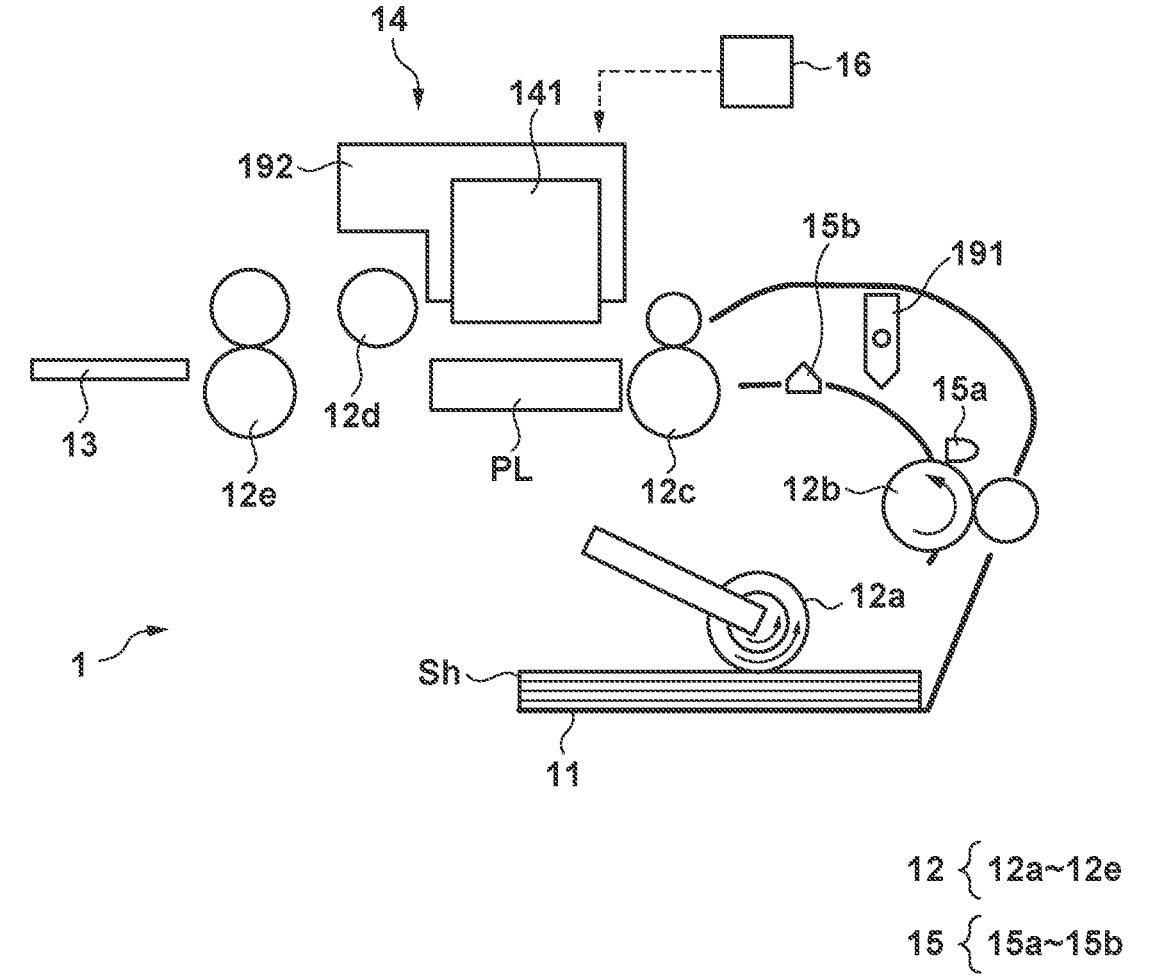
FIG. 1 is a schematic diagram illustrating an example of an overall configuration of a printing apparatus.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

First Embodiment

Figure 2:
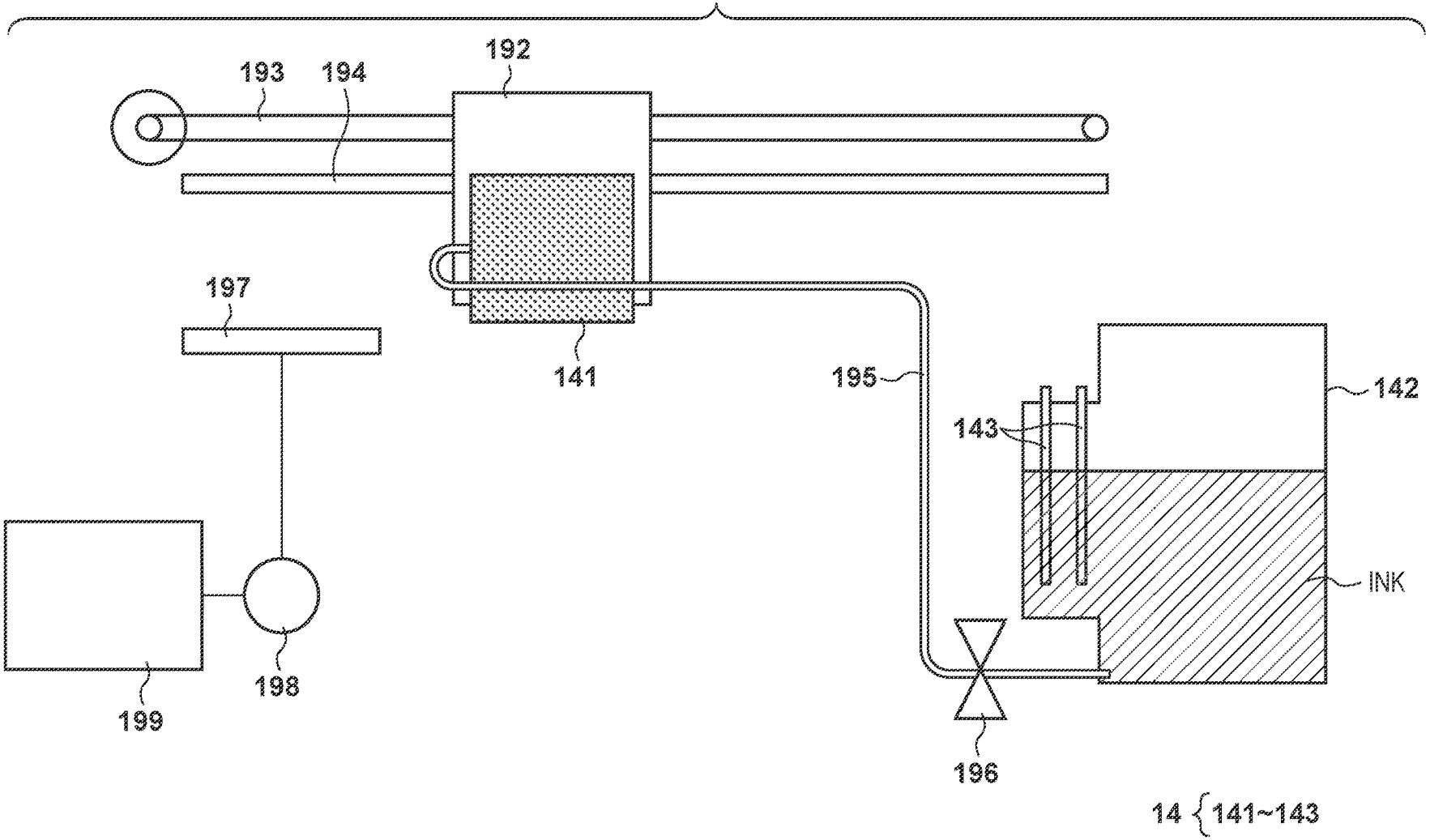
FIG. 2 is a schematic diagram illustrating an example of a partial configuration of a printing apparatus.

FIG. 1 is a schematic diagram illustrating an example of the overall configuration of a printing apparatus 1 according to the first embodiment. FIG. 2 is a schematic diagram illustrating an example of a partial configuration of a printing apparatus 1. The printing apparatus 1 is an ink jet printer in the present embodiment, and includes a placement unit 11, a conveyance unit 12, a discharge unit 13, a printing unit 14, a detection unit 15, and a print control unit 16.

It is possible to place a predetermined print medium Sh such as a sheet of paper material on the placement unit 11, and it is possible to stack two or more print mediums thereon. The placement unit 11 may represent a placement stand, a stacking unit, a stacking tray, or the like, and in the case where the print medium Sh is a paper material, it may also represent a sheet feeding unit, a sheet feeding stand, or a sheet feeding tray.

The conveyance unit 12 conveys print mediums Sh on the placement unit 11 one by one, loading the print medium Sh into the main body of the apparatus 1, and conveying the print medium Sh in the main body of the apparatus 1. After the printing unit 14 performs later-described printing on the print medium Sh being conveyed by the conveyance unit 12, the conveyance unit 12 discharges the printed print medium Sh from the discharge unit 13 to the outside of the apparatus 1. The discharge unit 13 may represent a discharge stand, a discharge tray, or the like, and in the case where the print medium Sh is a paper material it can also represent a discharge unit, a sheet discharge tray, a paper output tray, or the like.

In the present embodiment, the conveyance unit 12 includes a plurality of rollers (or roller pairs) 12*a* to 12*e*. Individual rollers 12*a* to 12*e* are described by names corresponding to their purpose or function, such as pickup rollers, separation rollers, conveyor rollers, and resist rollers, and are individually installed in corresponding positions in the device 1 body such that they can be driven. With this configuration, after the print medium Sh is loaded from the placement unit 11 into the apparatus 1 main body, the print medium Sh is transported in the apparatus 1 main body, and printing is performed by the printing unit 14, and then, the print medium Sh is discharged from the discharge unit 13 to the outside of the apparatus 1.

Between the rollers 12*b* and 12*c*, a flapper 191 for adjusting the conveyance path of the print medium Sh by the conveyance unit 12 may be installed. Thus, it is also possible to form a conveyance path corresponding to the size of the print medium Sh (the length in the conveying direction).

In the present embodiment, the printing unit 14 is configured to be capable of performing printing by an inkjet method, and includes a printhead 141 and a storage unit 142. The printhead 141 performs printing by ejecting ink while moving relative to the print medium Sh being conveyed on the platen PL by the conveyance unit 12. An image is formed on the print medium Sh by applying ink. Note that the concept of an image includes not only characters, symbols, graphics, photographs, and the like, but also spaces that can be formed therebetween.

As illustrated in FIG. 2, in the present embodiment, the printhead 141 is a serial head that performs printing while reciprocating by the carriage 192 in a direction that crosses (is substantially orthogonal to) the conveying direction of the conveyance unit 12 with respect to the print medium Sh. The carriage 192 can slide along the guide 194 by a belt mechanism 193 to reciprocate the printhead 141 by such a configuration. As another embodiment, the printhead 141 may be a line head that performs printing on the print medium Sh all at once across the entire region in a direction intersecting with the conveying direction.

The storage unit 142 is an ink tank configured to be capable of storing ink, and a plurality of storage units 142 (for example, Y (yellow), M (magenta), C (cyan), K (black), etc.) are provided in cases where the printing apparatus 1 supports color printing. The storage unit 142 can supply ink to the printhead 141 via a flow passage pipe 195. The flow passage pipe 195 is provided with a choke valve 196, thereby enabling control of the internal pressure in the flow passage pipe 195.

Further, although details will be described later, electrodes 143 are provided in the storage unit 142, and it is possible to supply an electrical signal to the electrodes 143. A pair of electrodes 143 is provided in the present embodiment, and they are assumed to extend downwardly from the upper portion of the storage unit 142 in the inner wall of the storage unit 142. The position of the lower side end portion of the pair of electrodes 143 corresponds to the height of the liquid level to be detected. Although both electrodes of the pair of electrodes 143 have the same length in FIG. 2, one electrode may be longer and the other electrode shorter. In this case, the position of the lower side end of the shorter electrode corresponds to the height of the liquid level to be detected.

According to the above printing unit 14, the printhead 141 receives ink from the storage unit 142, and performs printing by ejecting the ink onto the print medium Sh being conveyed by the conveyance unit 12. In other words, the conveyance unit 12 starts conveyance before the start of printing on the print medium Sh by the printhead 141, and conveys the print medium Sh to the start position of printing. After the printing by the printhead 141 is completed, the conveyance unit 12 conveys the print medium Sh to the discharge unit 13 and completes the conveyance.

In addition, a cap unit 197, a pump 198, and an absorber 199 are installed in the main body of the apparatus 1, and suction processing or recovery processing can be performed on (the ink discharge port of) the printhead 141.

The detection unit 15 is installed in one or more conveyance paths of the print medium Sh, and includes detection units 15*a* and 15*b* in the present embodiment. For example, each of the detection units 15*a* and 15*b* detects whether or not an end portion on the downstream side (the front side in the direction of conveyance by the conveyance unit 12)/the upstream side (the side opposite to the front side in the conveying direction) of the print medium Sh passes. With this configuration, the print medium Sh can detect whether or not conveyance by the conveyance unit 12 is being carried out appropriately.

The print control unit 16 drives/controls the individual elements of the apparatus 1 so that the printing operation of the printing apparatus 1 is appropriately carried out, and thereby performs printing control. For example, when a print job for printing is received from the external host device 9, for example, via the communication interface 17, the print control unit 16 drives/controls the conveyance unit 12 and the printing unit 14 to realize printing on the print medium Sh.

Here, the print control unit 16 typically includes one or more CPUs (Central Processing Unit) and one or more memories, and performs predetermined arithmetic operations. That is, functions of the print control unit 16 can be realized by the CPU, which is a processor, executing a predetermined program using data or information expanded in the memory. The processor may be a processor other than a CPU (e.g., an MPU or a GPU). A function of the print control unit 16 may be alternatively/concomitantly implemented by a semiconductor device, such as an ASIC (Application Specific Integrated Circuit), i.e., hardware or by software.

Figure 3:
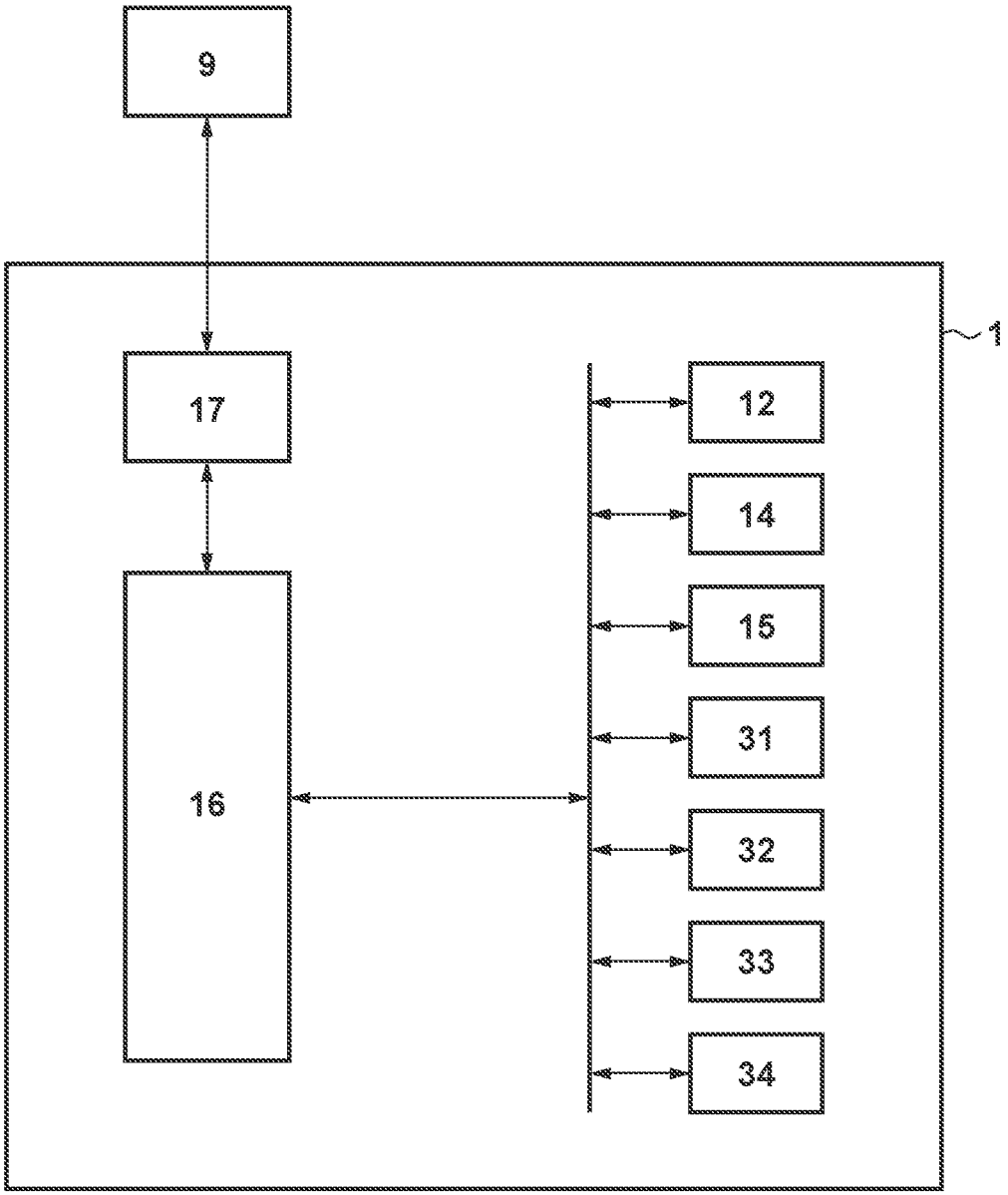
FIG. 3 is a block diagram illustrating a system configuration of a printing apparatus.

FIG. 3 is a block diagram illustrating a system configuration of the printing apparatus 1. The printing apparatus 1 further includes a signal output unit 31, a signal acquiring unit 32, a remaining amount determination unit 33, and a notification unit 34. The signal output unit 31, the signal acquiring unit 32, the remaining amount determination unit 33, and the notification unit 34 typically include one or more CPUs (Central Processing Unit) and one or more memories, respectively, and perform predetermined arithmetic operations. This is the same for the print control unit 16, and therefore description thereof is omitted.

Based on the detection result of the detection unit 15 and the processing result of the signal in the printing unit 14, the signal output unit 31 outputs a signal indicating completion of a printing task in which printing is performed on the print medium Sh for one sheet (or a signal associated therewith). For example, when N is an integer 2 or higher and K is an integer between 1 and (N−1) and the printing task for the Kth print medium Sh is completed, the signal output unit 31 outputs a signal indicating completion of the printing task for the Kth print medium Sh. In response to this, the conveyance unit 12 and the printing unit 14 are driven/controlled so that the printing with respect to the (K+1)th print medium Sh is started. In the present disclosure, a signal group for printing one sheet is expressed as a task, and a plurality of tasks are collectively expressed as a print job.

The signal acquiring unit 32 can acquire (detect) a signal related to the remaining amount of ink in the storage unit 142 (hereinafter referred to as "remaining ink amount signal"). Although details will be described later, in the present embodiment, the signal acquiring unit 32 supplies an electric signal (for example, a constant voltage or a constant current) to the pair of electrodes 143, and acquires (detects) a response from the pair of electrodes 143 as a remaining ink amount signal.

The remaining amount determination unit 33 can determine whether or not the remaining amount of ink in the storage unit 142 satisfies a criterion based on the acquisition result of the signal acquiring unit 32 (that is, the remaining ink amount signal). For example, when a constant current is applied between the pair of electrodes 143, the signal acquiring unit 32 acquires a potential difference between them as the remaining ink amount signal. For example, when the constant voltage is applied between the pair of electrodes 143, the signal acquiring unit 32 acquires a value of a current flowing between them as the remaining ink amount signal. The remaining amount determination unit 33 performs the above determination based on the remaining ink amount signal.

The notification unit 34 can output a notification signal when the remaining amount of ink in the storage unit 142 does not satisfy the criterion, that is, perform a predetermined notification based on the determination result of the remaining amount determination unit 33. Examples of this notification are outputting a notification signal in order to emit a light source provided in the apparatus 1 main body and outputting a notification signal in order to notify by voice. Further, a notification signal may be output so as to perform the display on the display unit of the apparatus 1 main body, and a notification signal may be output so as to perform the display on the display unit of the host device 9 side. As the content of the notification, it is preferable to notify the user that the storage unit 142 needs to be replaced or the ink needs to be replenished.

The signal output unit 31, the signal acquiring unit 32, the remaining amount determination unit 33, and the notification unit 34 described above are configured to be capable of exchanging signals with the print control unit 16. For example, when a printing task for the K-th print medium Sh is completed, the print control unit 16 receives a signal indicating completion of the printing task from the signal output unit 31, and drives/controls the conveyance unit 12 and the printing unit 14 so that the printing for the (K+1)th print medium Sh is started accordingly.

Further, for example, the print control unit 16 receives the determination result of the remaining amount determination unit 33 (a signal indicating whether or not the remaining amount of ink in the storage unit 142 satisfies the criterion). When the remaining amount of ink in the storage unit 142 does not satisfy the criterion, the print control unit 16 inhibits printing by the printhead 141 and/or inhibits the start of printing on the next print medium Sh (typically, controls the conveyance unit 12 and the printing unit 14 so that the printing operation on the next print medium Sh is not performed). At the same time, the print control unit 16 can also notify the user of the necessity of replacing the storage unit 142 or replenishing the ink by the notification unit 34.

Although the signal acquiring unit 32, the remaining amount determination unit 33, and the notification unit 34 are illustrated in this embodiment to be independent of the print control unit 16 in order to facilitate understanding, all or some of them may be included in the print control unit 16 in other embodiments.

In addition, although a description thereof will be omitted here for simplicity of explanation, the printing apparatus 1 may further include a driver, an electric motor, an encoder, or the like for operating the above-described elements.

Figure 4:
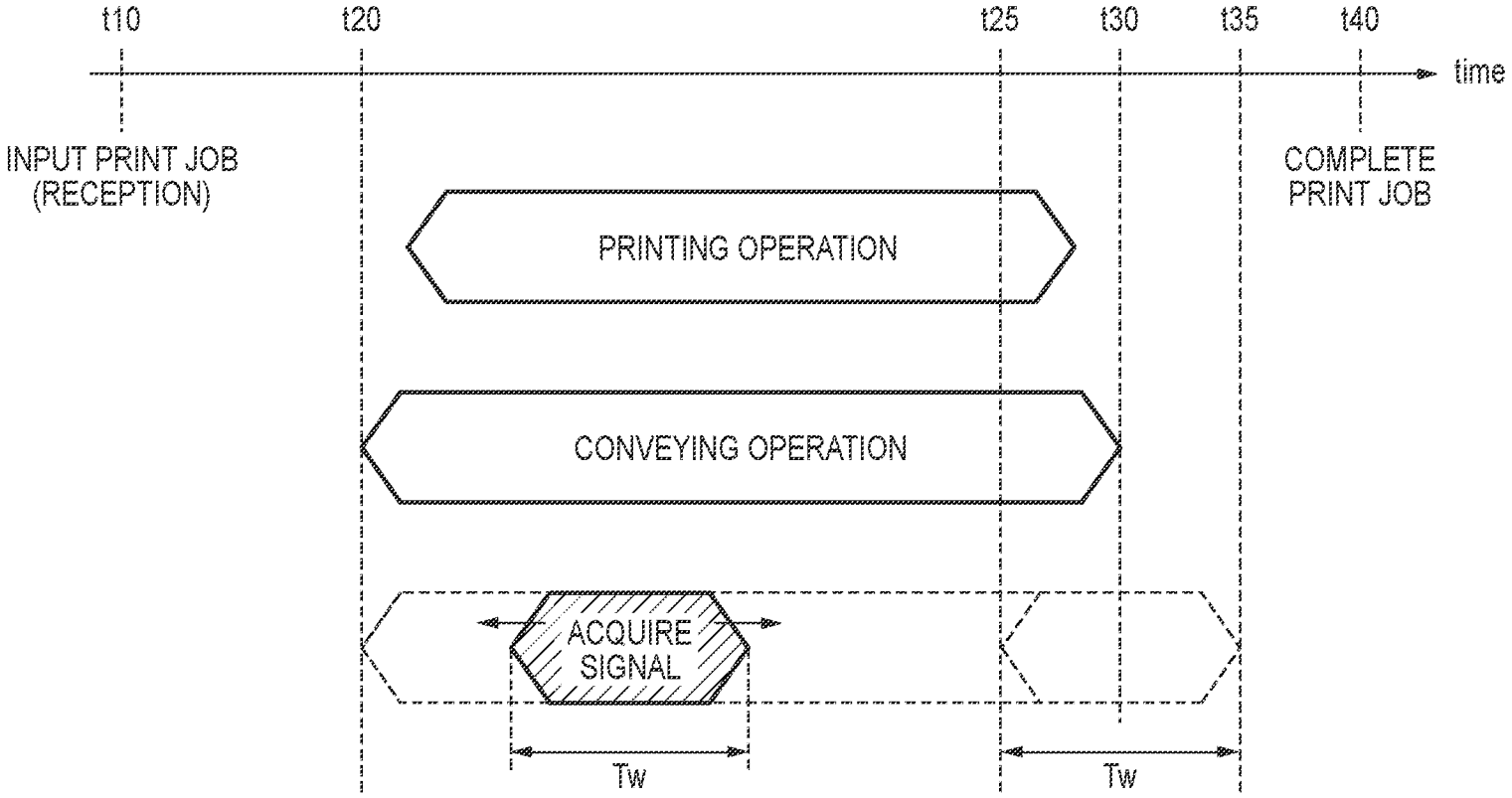
FIG. 4 is a timing chart illustrating the content of an operation when printing one sheet of print medium.

FIG. 4 is a timing chart illustrating the content of an operation when printing one sheet of print medium. The horizontal axis in FIG. 4 illustrates the time axis. In FIG. 4, it is assumed that the print job includes a printing task for printing one sheet.

At time t10, it is assumed that a printing task for printing one sheet is started. At time t20, the conveyance unit 12 is driven, and conveyance of the print medium is started, followed by the printing unit 14 being concomitantly driven. Thereafter, at time t30, the print medium Sh is discharged from the discharge unit 13, and conveyance by the conveyance unit 12 is completed. At time t40, a signal indicating completion of one printing task is output by the signal output unit 31. In a case where printing of a plurality of sheets is performed, as described above, a signal group for printing one sheet is expressed as a task, and a plurality of tasks are collectively expressed as a print job. Therefore, in the example of FIG. 4, since only one printing task is included in the printing job, it means that the completion of the printing task is the same as the completion of the printing job. In the present disclosure, the completion of the printing task means that processing from the start of conveyance of the print medium (start of sheet feeding) through printing (ink ejection), conveyance for sheet discharge, and up to determination of the remaining amount of ink is completed.

When a print job for performing a plurality of prints is inputted to the printing apparatus 1, the next (subsequent) printing task is started after the completion of the printing task for one sheet.

Here, as described above, the signal acquiring unit 32 supplies an electric signal to the pair of electrodes 143, and acquires a response from the pair of electrodes 143 as the remaining ink amount signal. Acquisition of the remaining ink amount signal requires energization between the pair of electrodes 143 for a predetermined time. For example, when the time required to obtain the remaining ink amount signal for one type of ink is 45 msec (milliseconds), the time Tw required to sequentially acquire the remaining ink amount signal for the four types of ink (hereinafter referred to as the "time required for signal acquisition") is 180 msec. The time required for signal acquisition Tw may be simply expressed as the required time or the like, or may be expressed as a response time or the like.

In some cases, the times required for signal acquisition Tw for two different types of inks may be different from each other, and in some cases, the time required for signal acquisition Tw varies depending on the remaining amount of ink, but here, the time required for signal acquisition Tw is assumed to be a fixed value for ease of understanding.

As described above, the time required for signal acquisition Tw is generated to obtain the remaining ink amount signal. Therefore, in the case of printing a plurality of sheets, for example, in a method in which the remaining ink amount signal is acquired by the signal acquiring unit 32 between two consecutive printing tasks or at a timing near thereto, there is a possibility that the time required for completing the printing tasks for a plurality of sheets will be long. Therefore, in the present embodiment, the acquisition of the remaining ink amount signal by the signal acquiring unit 32 is started so as to be completed at least before the time t40 at which the signal indicating the completion of the printing task of one sheet is output by the signal output unit 31.

When notification by the notification unit 34 is performed simultaneously with completion of the printing task by the signal output unit 31, (notification indicating that replacement of the storage unit 142 or replenishment of ink is necessary), acquisition of the remaining ink amount signal by the signal acquiring unit 32 needs to be completed before time t40. Therefore, the acquisition of the remaining ink amount signal by the signal acquiring unit 32 may be started so as to be completed at or before the time t35 which is before the time t40.

According to the above driving embodiment, it is possible to shorten the time from the time t30 at which the conveyance by the conveyance unit 12 is completed to the time t40 at which the signal indicating the completion of the printing task for one sheet is outputted by the signal output unit 31. In this case, in order to complete the acquisition of the remaining ink amount signal by the signal acquiring unit 32 at time t35, the acquisition can be started at time t25. Therefore, it can be said that the acquisition of the remaining ink amount signal by the signal acquiring unit 32 may be started between the times t20 to t25.

From the viewpoint of printing control, the conveyance of the print medium Sh is started (time t20) in response to the input of the print job and the conveyance is completed (time t30), and the printing by the printhead 141 is performed during that period (time t20 to t30), and then the print job is completed (time t40). In this series of operations, according to the present embodiment, the acquisition of the remaining ink amount signal may be started between the times t20 to t30 and more preferably between the times t20 to t25.

As described above, according to the present embodiment, the signal acquiring unit 32 starts acquiring the remaining ink amount signal after the start of the conveyance by the conveyance unit 12 (time t20) and before the completion of the conveyance (time t30). More specifically, in the present embodiment, the process for acquiring the remaining ink amount signal is started on the condition (trigger) that the conveyance of the print medium is started by the conveyance unit 12. Thus, the remaining amount determination unit 33 can efficiently perform the processing for determining the remaining amount of ink at the timing of completion of the conveying operation (discharge completion) based on the acquisition result of the signal acquiring unit 32. Further, in the case of printing a plurality of sheets, the time required for completing the printing does not become long, and printing of the plurality of sheets can be performed quickly in order. Therefore, according to the present embodiment, it is possible to speed up the printing of a plurality of sheets.

Figure 5:
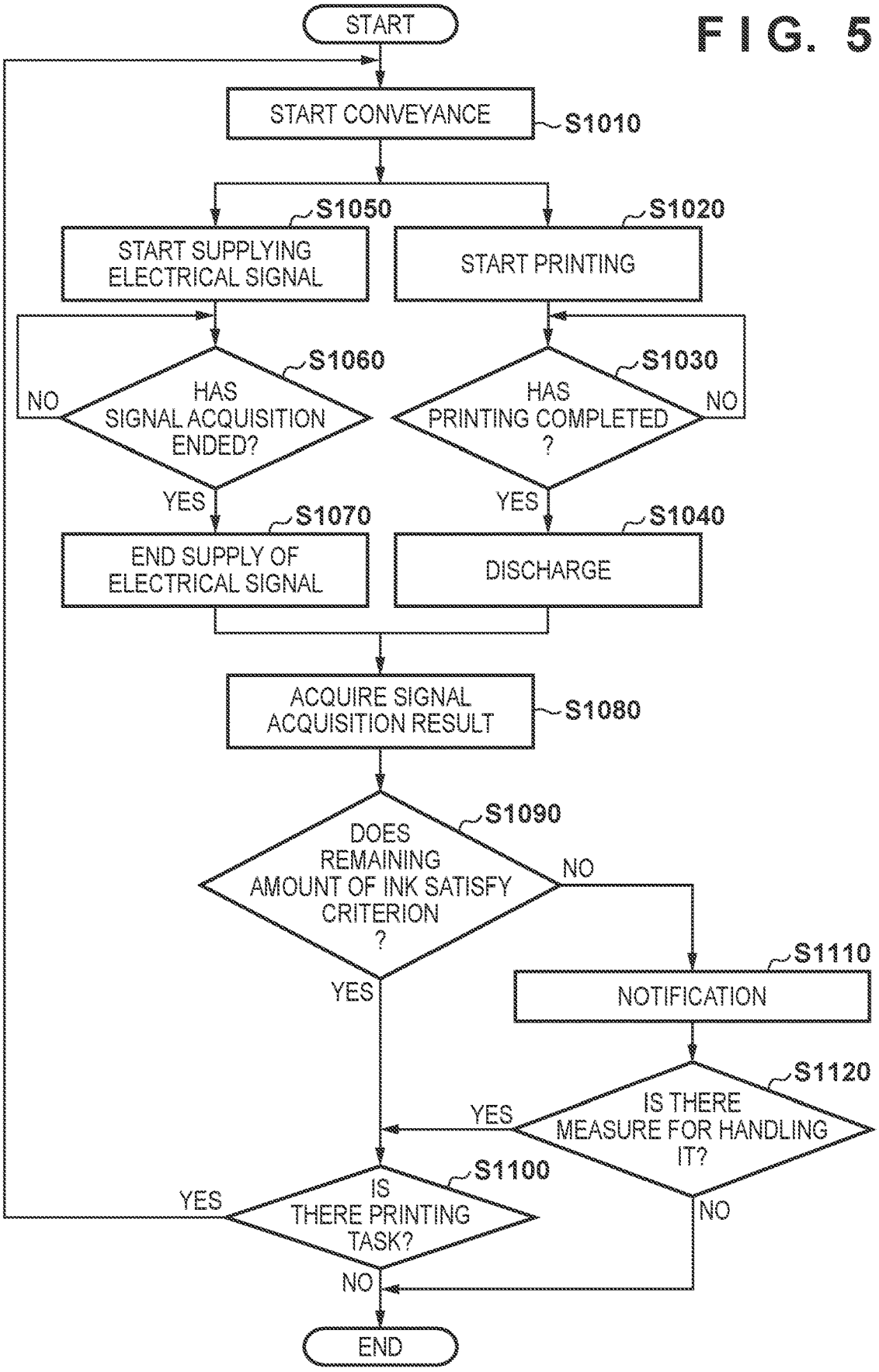
FIG. 5 is a flowchart illustrating the contents of driving/control of the printing apparatus.

FIG. 5 is a flowchart based on the above driving mode. This flowchart is mainly performed by the print control unit 16 based on the input of a print job for printing one sheet. The outline is that, after the start of the conveyance by the conveyance unit 12 and before the completion of the conveyance (in parallel with the printing on the print medium that is being conveyed), acquisition of the remaining ink amount signal is started, and after completion of the conveying operation, based on the remaining ink amount signal, a determination as to whether or not the remaining amount of ink satisfies the criterion is made.

In step S1010 (hereinafter may be referred to simply as "S1010". The same applies to other steps described later), the conveyance of the first print medium Sh to a predetermined position by the conveyance unit 12 is started (sheet feeding). More specifically, the print medium Sh is loaded into the printing apparatus 1 main body from the placement unit 11 by the pickup roller (sheet feeding), and is conveyed to the start position of printing by the printing unit 14.

In step S1020, printing is performed on the print medium Sh fed by the printhead 141. As described above, since the printhead 141 is a serial head, here, as an example, it is assumed that printing for one scan (printing for one round trip of the carriage 192) is performed as printing on the print medium Sh for one sheet.

In step S1030, it is determined whether or not printing of one sheet has been completed. If the printing is completed, the process proceeds to step S1040; otherwise, the process proceeds to step S1030 again.

In step S1040, the print medium Sh is conveyed by the conveyance unit 12 and discharged (ejected) to the discharge unit 13. Incidentally, the operation from step S1020 to step S1040 corresponds to the printing operation and the subsequent the conveyance operation.

Next, the process of acquiring the remaining ink amount signal that is performed in parallel with the printing operation and the subsequent conveyance operation on the condition that the conveyance of the print medium is started will be described.

In step S1050, supplying of an electrical signal to the pair of electrodes 143 is started and the response is received from the pair of electrodes 143 as the remaining ink amount signal. In the present embodiment, a constant current is applied between the pair of electrodes 143, but as another embodiment, a constant voltage may be applied between the pair of electrodes 143.

In step S1060, it is determined whether or not the acquisition of the remaining ink amount signal by the signal acquiring unit 32 has been completed. If the acquisition of the remaining ink amount signal is completed, the process proceeds to step S1070; otherwise, the process proceeds to step S1060 again.

In step S1070, supplying of the electrical signal to the pair of electrodes 143 is ended.

In step S1080, in response to completion of discharging of the printed print medium Sh, the remaining ink amount signal obtained between step S1050 and step S1070 is obtained as a signal acquisition result. Specifically, the remaining ink amount signal is acquired in response to a signal indicating completion of ejection.

In step S1090, it is determined whether or not the remaining amount of ink in the storage unit 142 satisfies the criterion based on the remaining ink amount signal obtained in step S1080. If the remaining ink amount satisfies the criterion, the processing proceeds to step S1100; otherwise, the processing proceeds to step S1110. The case where the remaining amount of ink satisfies the criterion indicates a case where the remaining amount of ink is larger than a predetermined threshold. Meanwhile, the case where the remaining amount of ink does not satisfy the criterion is a case where the remaining amount of ink is less than a predetermined threshold.

In step S1100, in response to the determination in step S1090 that the remaining amount of ink satisfies the criterion, it is determined whether or not the printing task remains in the print job. For example, when the first printing task is executed, if the second and subsequent printing tasks exist, it is determined that there is a printing task. When the determination result in step S1100 is YES, the process returns to step S1010, the second print medium Sh is fed, and the conveyance is started. In a case where YES is determined in step S1100, a signal indicating the completion of the first printing task may be outputted. In response to this signal, the second print medium Sh is fed. If NO is determined in step S1100, all of the print jobs have been completed, and this flow is ended.

In step S1110, a signal indicating that the printing should be interrupted is outputted in response to the determination by step S1090 that the remaining amount of ink does not satisfy the criterion, and the notification unit 34 issues a notification (indicating that the storage unit 142 needs to be replaced or the ink needs to be replenished).

In step S1120, it is determined whether or not a measure (such as replacing the storage unit 142 or replenishing the ink) corresponding to the above notification has been taken. If a measure has been taken, the processing proceeds to step S1100, otherwise the process ends.

According to this flowchart, in response to the start (sheet feeding) of the conveyance by the conveyance unit 12, the remaining ink amount signal is acquired in parallel with the printing on the print medium. This makes it possible to efficiently determine whether or not the remaining amount of ink satisfies the criterion after the print medium is discharged.

Second Embodiment

The second embodiment differs from the above-described first embodiment mainly in that the ink consumption amount is considered when determining step S1090.

Figure 6:
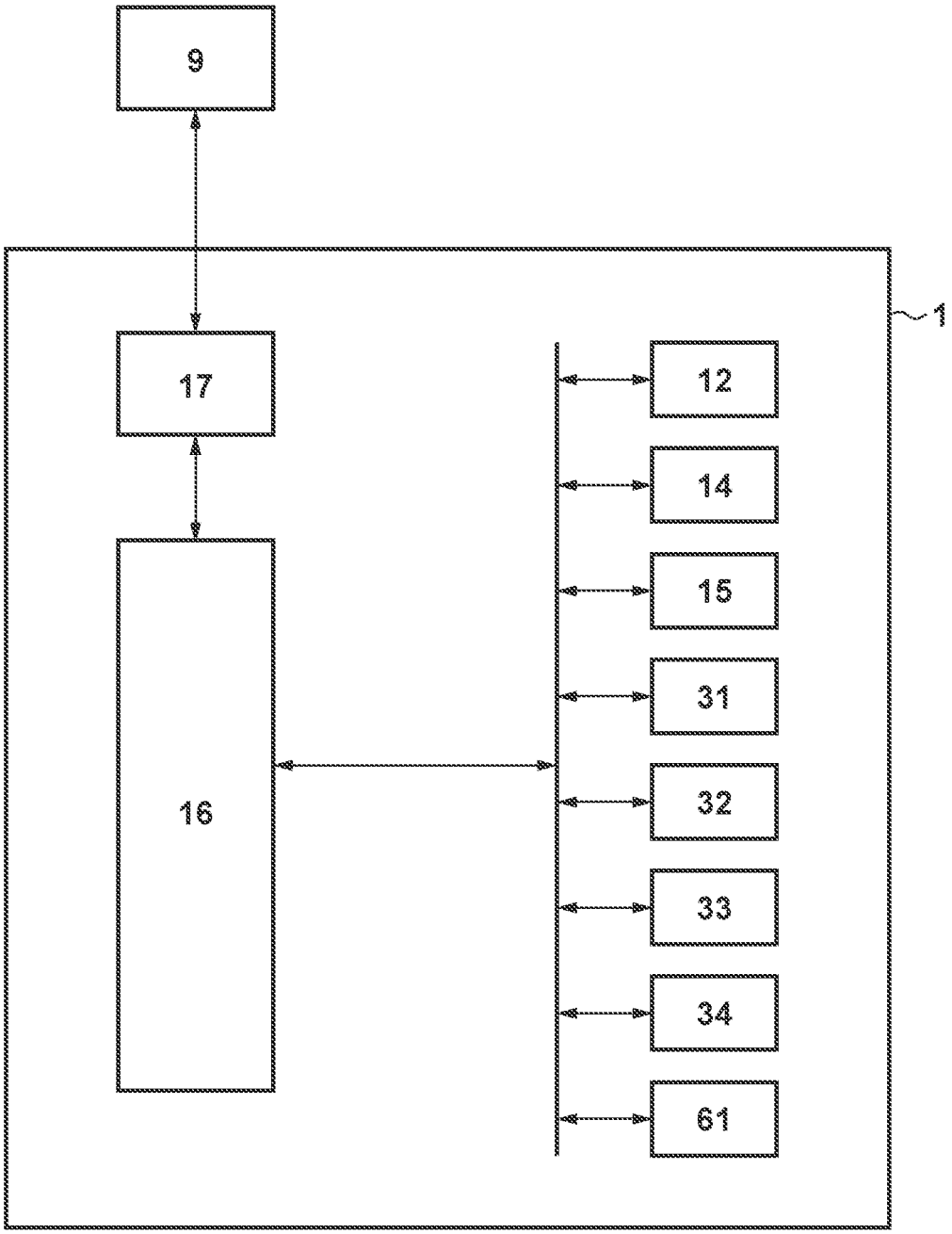
FIG. 6 is a schematic diagram illustrating another example of a partial configuration of the printing apparatus.

FIG. 6 illustrates an example of the configuration of a printing apparatus 1 according to the second embodiment. The printing apparatus 1 further includes a discharge amount measuring unit 61. The discharge amount measuring unit 61 measures the ink ejection amount (that is, the ink consumption amount in the printhead 141) of the printhead 141. The discharge amount measuring unit 61 can measure the ink consumption amount based on, for example, the number of times that the individual ink discharge ports are driven. The discharge amount measuring unit 61 may be a part of the printing unit 14.

In the present embodiment, in step S1090 (see FIG. 5), the remaining amount determination unit 33 determines whether or not the remaining amount of ink in the storage unit 142 satisfies the criterion based on the measurement result (i.e., the remaining ink amount signal) of the discharge amount measuring unit 61 in addition to the acquisition result (i.e., the ink consumption amount) of the signal acquiring unit 32. That is, according to the present embodiment, when determining step S1090, the cumulative ink consumption amount during execution of printing thus far is considered.

In the method using the signal response from the pair of electrodes 143, it is possible to determine whether or not the remaining amount of ink is larger than the threshold value based on the fact that the value of the signal output is different depending on whether or not the ink is in contact with the electrode, but it is difficult to determine the detailed remaining amount of ink. That is, it is possible to judge whether or not the remaining amount of ink is less than a predetermined threshold (for example, 30% of the remaining amount of ink) by the signal response from the electrode 143, but it is impossible to judge where in 0 to 30% the remaining amount is. Therefore, in the present embodiment, by using the ink discharge amount (dot count), it is possible to obtain the remaining ink amount in more detail. For example, it is determined from the signal response from the electrode 143 that the remaining amount of ink is less than a predetermined threshold (for example, the remaining amount of ink being 30%), and the remaining amount of ink can be determined to be 25% by the determination using the dot count.

Therefore, by using this embodiment, in the determination of step S1090, the criterion of the remaining ink amount can be set to a criterion that differs from the criterion of the threshold value that can be detected in the signal response from the electrodes 143. For example, even if the criterion in step S1090 is set to 20% and the remaining ink amount is determined to be smaller than the predetermined threshold from the signal response from the electrodes 143, the processing may proceed to YES in step S1090 until it is determined to be less than 20% in the determination using the dot count. Further, for example, it is also possible to change the notification content in step S1110 in the case where the remaining ink amount is determined to be smaller than the predetermined threshold value by the signal response from the electrode 143 and in the case where it is determined to be less than 20% by the determination using the dot count.

Generally, the printing apparatus 1 further includes a storage device (not illustrated), such as a DRAM (Dynamic Random Access Memory). The printing apparatus 1 can utilize the storage device as an information holding unit that holds the measurement result of the discharge amount measuring unit 61 and the information holding unit that holds the acquisition result of the signal acquiring unit 32.

(Applications)

In the first and second embodiments, the user does not access the inside of the apparatus 1 for any purpose until the completion of the print job, for example, and there was no case where the user opens or closes the maintenance cover of the printing apparatus 1 during the execution of printing.

In reality, however, the user may access the device 1 (such as manipulation of a cover), in which case the printing is typically interrupted. Then, when the user finishes accessing and printing is resumed, a remaining ink amount signal acquisition similar to that of step S1050 to step S1070 is performed (hereinafter, referred to as "signal acquisition" for simplification of explanation), and it can be determined whether or not the remaining amount of ink satisfies the same criterion as in step S1090. As a result, the printing is restarted under a state in which the printing can be restarted.

Therefore, when there is an access by the user, there is a possibility that the first signal acquisition to be performed at the time of printing of one sheet and the second signal acquisition to be performed due to the above access will be performed at least partially in an overlapping manner. In such a case, it is sufficient that the second signal acquisition is started after the first signal acquisition is completed. That is, the second signal acquisition is not started in response to the end of the above access by the user, but may be started after the completion of the first signal acquisition.

(Program)

The present invention may be realized by supplying a program for realizing one or more functions of the above-described embodiments to a system or an apparatus via a network or a storage medium, and reading and executing the program by one or more processors in a computer of the system or the apparatus. For example, the present invention may be implemented by circuits (e.g., ASIC) that implement one or more functions.

(Other)

In the above description, the printing apparatus 1 using the inkjet printing method is described as an example, but the printing method is not limited to the above-described embodiments. The printing apparatus 1 may be a single function printer having only a printing function, or may be a multi-function printer having a plurality of functions such as a printing function, a fax function, and a scanner function. Further, for example, a manufacturing apparatus for manufacturing a color filter, an electronic device, an optical device, a microstructure, or the like in a predetermined printing method may be used.

Also, "print" as used in the present specification should be construed broadly. Therefore, the concept of "printing" is irrespective of whether or not an object formed on the print medium is significant information such as characters, graphics, etc., and whether or not it is manifested so as to be visually perceivable by a human being.

Also, "print medium" should be interpreted broadly similarly to "print" as described above. Thus, the concept of "print medium" may include any member capable of receiving ink, such as cloth, plastic film, metal plate, glass, ceramics, resin, wood, leather, and the like, in addition to commonly used paper.

Also, "ink" should be interpreted broadly similarly to "print" as described above. Thus, the concept of "ink" may include liquids that form images, designs, patterns, etc. by being applied onto a print medium, as well as ancillary liquids that may be subjected to processing of the print medium, processing of the ink (e.g., solidification or insolubilization of colorants in the ink applied to the print medium), etc. In this respect, the printing apparatus 1 may be reworded as a liquid discharge apparatus, an image forming apparatus, or the like. Similarly, the printhead 141 may be reworded as the liquid discharge head, the discharge head, or simply a head or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-210592, filed on Dec. 18, 2020, which is hereby incorporated by reference herein in its entirety.

What is claimed is:

1. A printing apparatus, comprising a conveyance unit configured to convey a print medium;

a storage unit configured to store ink;

a printhead configured to discharge ink supplied from the storage unit to print on the print medium; and a signal acquiring unit configured to acquire a signal related to a remaining amount of ink in the storage unit, wherein the signal acquiring unit, in accordance with a start of conveyance by the conveyance unit, starts acquisition of the signal.

2. The printing apparatus according to claim 1, further comprising a remaining amount determination unit configured to determine whether or not a remaining amount of ink in the storage unit satisfies a criterion based on an acquisition result of the signal acquiring unit.

3. The printing apparatus according to claim 2, wherein the remaining amount determination unit performs the determination in accordance with a discharge of a single print medium printed by the printhead.

4. The printing apparatus according to claim 2, further comprising a discharge amount measurement unit configured to measure a discharge amount of ink of the printhead, wherein the remaining amount determination unit performs the determination further based on a measurement result of the discharge amount measuring unit.

5. The printing apparatus according to claim 2, further comprising a print control unit configured to, in a case where a remaining amount of ink in the storage unit does not meet the criterion, inhibit a start of printing on a next print medium.

6. The printing apparatus according to claim 2, further comprising a print control unit configured to, in a case where the remaining amount of ink in the storage unit does not satisfy the criterion, inhibit printing by the printhead.

7. The printing apparatus according to claim 2, further comprising a notification unit configured to perform a predetermined notification in a case where the remaining amount of ink in the storage unit does not satisfy the criterion.

8. The printing apparatus according to claim 7, wherein content of the predetermined notification is content that notifies a user that replacement of the storage unit is necessary.

9. The printing apparatus according to claim 7, wherein content of the predetermined notification is content that notifies a user that replenishment of ink is necessary.

10. The printing apparatus according to claim 1, wherein the conveyance unit starts the conveyance prior to starting printing on a print medium by the printhead, and completes the conveyance after the printing by the printhead is completed.

11. The printing apparatus according to claim 1, wherein an electrode is provided in the storage unit, and the signal acquiring unit supplies an electrical signal to the electrode, and acquires a response from the electrode as the signal related to the remaining amount of ink.

12. A printing method, comprising:

conveying a print medium;

discharging ink supplied from a storage unit for storing ink to print on the print medium; and acquiring a signal related to a remaining amount of ink in the storage unit, wherein, in accordance with a start of the conveyance, the acquisition of the signal is started.

* * * * *